United States Patent [19]

Jolly et al.

[11] 4,010,316

[45] Mar. 1, 1977

[54] HIGH VOLTAGE ELECTRICAL INSULATOR HAVING MAGNETIC ELEMENTS TO PREVENT FLASHOVER

[75] Inventors: David C. Jolly, Boston; Daniel J. King, Allston, both of Mass.

[73] Assignee: Massachusetts Institute of Technology, Cambridge, Mass.

[22] Filed: Mar. 12, 1976

[21] Appl. No.: 666,368

[52] U.S. Cl. ..... 174/140 R

[51] Int. Cl.[2] ..... H01B 17/42

[58] Field of Search ..... 174/140 R, 140 C, 140 S, 174/141 R, 141 C, 142, 211; 317/72, 73, 74

[56] References Cited

UNITED STATES PATENTS

| | | | |
|---|---|---|---|
| 523,697 | 7/1894 | Voorhees | 317/73 |
| 3,581,154 | 5/1971 | Willox | 317/73 X |
| 3,963,858 | 6/1976 | Cheng et al. | 174/140 R X |

FOREIGN PATENTS OR APPLICATIONS

| | | | |
|---|---|---|---|
| 287,607 | 12/1968 | Australia | 174/140 R |
| 558,053 | 5/1923 | France | 317/73 |
| 1,930,406 | 12/1970 | Germany | 174/140 R |

*Primary Examiner*—Laramie E. Askin

*Attorney, Agent, or Firm*—Arthur A. Smith, Jr.; Robert Shaw; Martin M. Santa

[57] ABSTRACT

An electrical insulator composed of one or more electrical insulating skirts or sheds or shells; at least some of which skirts or sheds or shells have embedded therein or otherwise associated therewith a permanent magnet (usually annular in shape) that serves to create a magnetic field region through which an arc, in the event of incipient flashover, must pass as it proceeds radially from one terminal of the insulator to the other terminal thereof. The magnetic field is oriented to have a component at the surface of the insulator, that is orthogonal to said surface. As the arc passes through the field region it is deflected sideways or circumferentially and rotates in a circle, thereby dissipating the energy in the arc. The effect of the field can be increased by having two or more annularly shaped permanent magnets embedded in the insulator and spaced radially from one another, successive magnets having oppositely directed fields to the magnet or magnets immediately adjacent the same.

16 Claims, 11 Drawing Figures

HIGH VOLTAGE ELECTRICAL INSULATOR HAVING MAGNETIC ELEMENTS TO PREVENT FLASHOVER

The Government has rights in this invention pursuant to Grant No. 134783X and Institutional Patent Agreement No. 0010, awarded by the National Science Foundation.

The present invention relates to electrical insulators that may be used, for example, on high voltage transmission lines and, in particular, to insulators to decrease the occurrence of flashover.

As used herein the term "insulator" denotes rod-type insulators, post-type insulators, pin-type insulators, bushings, insulator strings and the like. Such insulator usually comprises a number of porcelain or glass skirts or sheds or shells but may have cast epoxy or other synthetic material skirts or sheds or shells as well. The terms "skirt", "shed" and "shell" (or modifications thereof) are used herein to denote the same part of the insulator. Attention is called to an application for patent Ser. No. 570,147, filed Apr. 21, 1975 (Cheng et al), now U.S. Pat. No. 3,963,858, that is directed to solving the same general type problems as the present invention. Work done to date indicates, however, that the apparatus hereinafter described is particularly well suited to preventing flashover in high voltage d-c systems. The background material that now follows is found, also, in the prior application.

Contamination flashover is a form of arc discharge across the moist surface of an insulator upon which has been previously deposited soluble particulates so that it has become conductive. Once the arc discharge, which usually starts either from the central cap or pin of the insulator, has bridged over the top procelain or other insulating surface thereof and the creepage path beneath it, the insulating strength of that insulator is entirely gone. The result is that other insulators in series, in an insulator string, for example, with increased voltage stresses, may be similarly affected and eventually an outrage occurs. The necessary ingredients for a flashover are moisture and contaminant substances. The former is usually supplied by nature in the form of fog, dew, rain, ice, etc. The sources of contamination can range from industrial pollution to bird droppings. A survey by an IEEE working Group, tabulated a great variety of such contaminants: "A Survey of the Problem of Insulator Contamination in the U.S. and Canada — Part I", IEEE Trans. on Power Apparatus and Systems, PAS-90, pp 2577–2585 (1971). With the presence of moisture and contamination, the flashover process is thought to occur as follows. During dry weather, pollutants are deposited on an insulating surface. When the surface becomes moist, some pollutants are dissolved and the surface starts to conduct electrically. The passage of leakage current produces ohmic heating and the area around the pin, where the electric field is highest, starts to dry. Subsequently, a dry zone is formed around the pin and low current arcs can now bridge this zone. The heat of the arc evaporates more water enlarging the dry zone and the arc. Sometimes, the arc lengthens to some extent and extinguishes. Other times, the arc grows until the insulator string is bridged and full fault current then flows, causing circuit breakers to be tripped. This picture embodies the essence of what happens during a contamination flashover. After a flashover, the line may or may not be automatically reclosed, depending on whether the factors causing the fault have been removed or not. Frequently, it may be many minutes before the line can support voltage again. Also, on occasion, the insulators involved are damaged by the arcs and must be replaced.

The propagation of arcs across the water film is also very much dependent upon the insulating surface conditions. A new and clean insulator, as a rule, performs much better than an old and contaminated one. On the surface of the former, moisture tends to bead up, forming separate droplets. While, on the surface of the latter, moisture can wet the surface quite readily, thus increasing the leakage current and initiating arc discharges. The ability to maintain either a clean insulating surface or a water-repellent one has therefore become a major criterion in insulator design. Keeping an insulator clean can be accomplished by regular washing; while making the insulating surface water-resistant can be achieved by greasing.

The above description illustrates that certain necessary conditions must be satisfied in order for a flashover process to complete itself. The most important ones are contamination, moisture, leakage current, dry zone, arc initiation and arc propagation. Each is a prerequisite to the occurrence of the chain of events that leads to flashover. If somewhere along the way a vital condition is missing, then the flashover process will be stopped.

The fact that all conditions just noted must be met has pointed a way to some possible solutions of the problem. To reduce pollution, insulators have been designed to contain an oil bath that interrupts the flow of current which might support surface discharging. To lessen the impact of moisture, special skirts or sheds or shells have been designed so that at least a portion of the leakage path is kept dry. Some insulators are also designed in such a way that rain can be used as a cleansing agent. External washing equipments have also been installed in heavily polluted regions so that when contamination has reached a certain level, washing starts automatically. Depending on locality, however, washing usually has to be performed fairly frequently, making it a costly operation. A more economical method probably is that of greasing the insulating surface of an insulator. Grease insures that an insulating surface stays water-repellent and needs to be reapplied only once every two years or so. Furthermore, the improvement in insulator performance is far more significant. The primary function of the grease is to break up the moist film so that surface resistance increases.

Finally, increasing the leakage path will increase the insulator performance, to some degree. However, there is some mechanical limit to the size and weight of an insulator. All of the above modifications have one thing in common — increasing the surface resistance of an insulator so that an arc will not be formed.

The initiation of an arc depends on the formation of a dry zone, as described before. If the dry zone can be widened sufficiently, then the field can be reduced significantly so that breakdown will be far less likely. This concept is utilized in the design of a semi-conductive insulator. A small current is allowed to flow on the surface to keep it dry all the time through ohmic heating. The development of a semiconductive insulator is still in progress.

Comparatively little study has been done in the area of stopping an arc, once formed, from flashover.

Rumeli (A. Rumeli, "The Mechanisms of Flashover of Polluted Insulation," Ph.D. thesis, University of Strathclyde, Glasgow, 1967, Department of E.E. ) used the idea of gradient rings which are metallic bands taped onto the sheds of an insulator. The rings, ideally, will forcibly set the potential distribution in such a way that electric stresses will be more evenly distributed along the whole leakage path. This method has also been called "equalization of potential". The Rumeli approach also relies on the fact that the electric field is reduced considerably when it comes in contact with the metal bands. The reduction in field may retard the arc motion sufficiently to prevent a flashover. Though acceptable conceptually, the use of gradient rings has yet to be proven in practice.

Accordingly, an object of the present invention is to provide an insulator that will, when subjected to contamination and moisture under conditions of high voltage, resist flashover.

Another object is to provide an insulator that is particularly well adapted to prevent flashover in high voltage direct current systems.

These and still further objects are brought out hereinafter and are particularly delineated in the appended claims.

The foregoing objects are achieved in an insulator composed, usually, of a plurality of electrically insulating skirts or sheds or shells formed in such a way that an arc in the course of flashover with respect to each skirt or shed or shell must occur by moving generally radially across one surface of the skirt or shed or shell to the other surface thereof. Means is provided for creating a magnetic field region at least at one surface of the skirt or shed or shell in the path of said arc and having a component perpendicular to said at least one surface. The field is created such that the arc in the course of flashover must pass through said region. In the preferred embodiment of the invention, the field region is annularly shaped and is, indeed, two field regions, one at one surface of the insulator and one at the other surface thereof. An arc, in the course of incipient flashover, may form at either surface, the field being created by an annular permanent magnet embedded in or otherwise associated with the skirt or shed or shell and coaxial therewith; the plane of the annulus is substantially orthogonal to the axis of the insulator.

The invention is hereinafter described with reference to the accompanying drawing in which.

Figure 4:
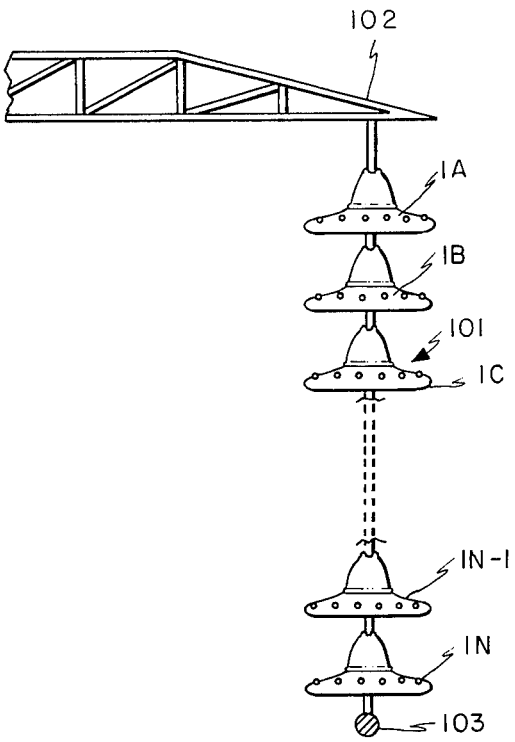
FIG. 4 shows a plurality of insulators, similar to the insulator of FIG. 1, in the form of an insulator string hanging from the arm of a transmission tower.

Before going into a detailed discussion of the several embodiments of the invention herein disclosed, there is given in this and the next two paragraphs, a brief, preliminary, overall explanation. The present invention has meaning mostly with regard to high voltages, above, say 100,000 volts, but can be useful at lower voltages. In any event, as is well known in the art, the function of an insulator is to isolate a point or region at one electric potential from a point or region at another electric potential. Thus, with reference to FIG. 4, for example, an insulator string 101 serves to insulate an arm 102 from a conductor 103, that is, the insulator string acts to prevent flashover from occurring between the conductive arm 102 and the conductor 103.

All the embodiments herein serve the same general functions, but slightly differing terms have arisen in the art to describe the structural parts of different-type insulators. By way of illustration, the insulator string 101 is, in the context of the present specification and in the art, appropriately called an insulator without further qualification and performs the same function as the pin-type insulator shown at 105 in FIG. 6, the post-type insulator shown at 106 in FIG. 7 and the rod-type insulator shown at 107 in FIG. 8, as well as a bushing (or bushing insulator), not shown. As later described herein, the insulator string 101 consists of a plurality of insulators 1A . . . 1N like the insulator shown at 1 in FIGS. 1–3 and each includes what is called a shell or electrically insulating shell herein (e.g., the sheel or dielectric body labeled 4 in FIGS. 1–3). The function of the insulating shells of the insulators 1A . . . is identical to that of shells or skirts or sheds 40A, 40B . . . of the pin-type insulator 105, or the skirts or sheds labeled 41A, 41B . . . of the post-type insulator 106 or 42A, 42B . . . of the rod-type insulator 107. In each case in an operating system, an arc in the course of flashover with respect to each insulating shell (or each insulating skirt or shed) must occur by moving generally radially across one surface of the shell (or skirt or shed) to the other surface thereof. By way of illustration and with reference to FIGS. 1 and 3, flashover, if it occurs, will be in the form of an arc that starts at a conductive cap 8 and moves generally radially across the upper surface labeled 4A of the shell 4 to the lower surface 4B thereof and thence to a conductive pin 9 (or vice versa).

Figure 1:
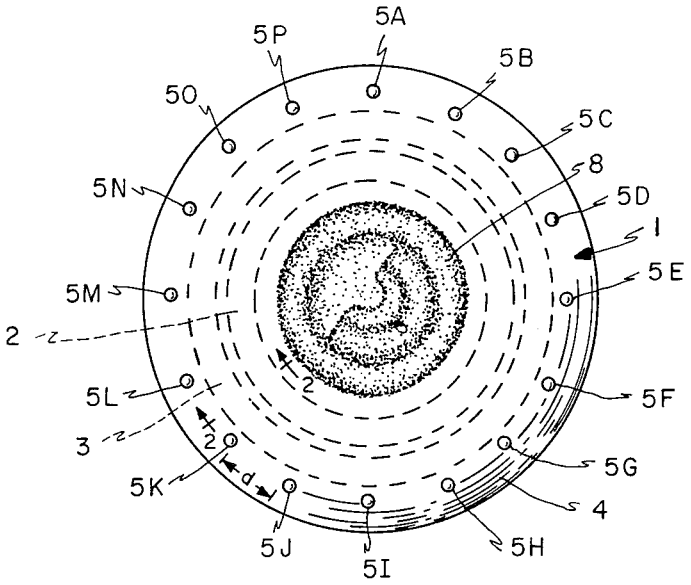
FIG. 1 is a plan view of an insulator composed of a single circularly symmetric skirt or shed or shell having embedded therein two annularly shaped permanent magnets, coaxially disposed with respect to each other and to the insulator and having, as well, a plurality of discrete electric conductors disposed in a circle radially outward from the two magnets.
Figure 2:
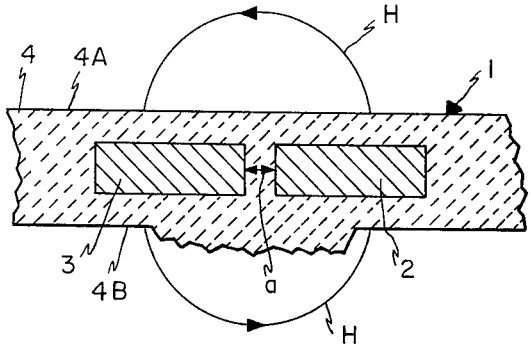
FIG. 2 is an enlarged section view, partly schematic in form, taken upon the line 2—2 in FIG. 1 looking in the direction of the arrows.
Figure 3:
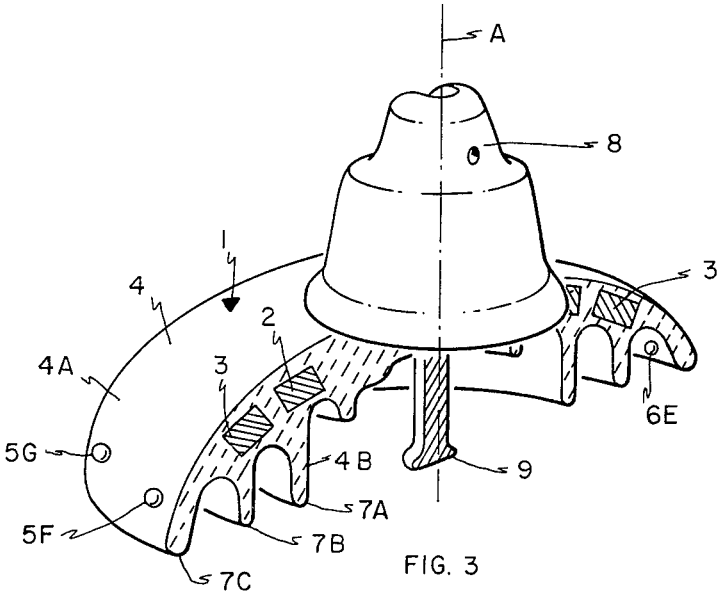
FIG. 3 is an isometric section view of the insulator shown at FIG. 1.
Figure 9:
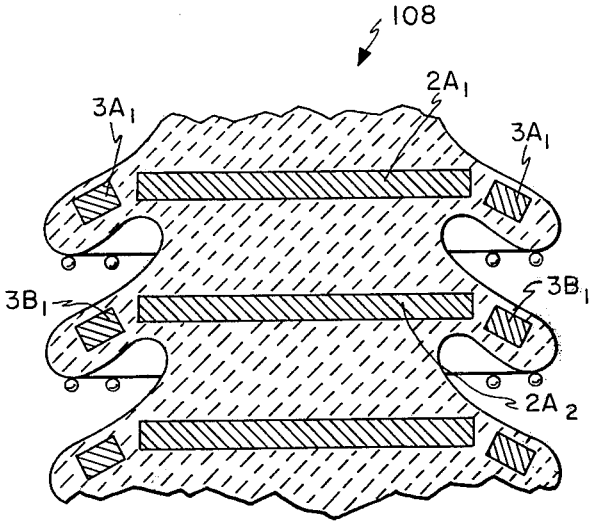
FIG. 9 is a side section partial view of a rod-type insulator embodying the present inventive concepts.
Figure 10:
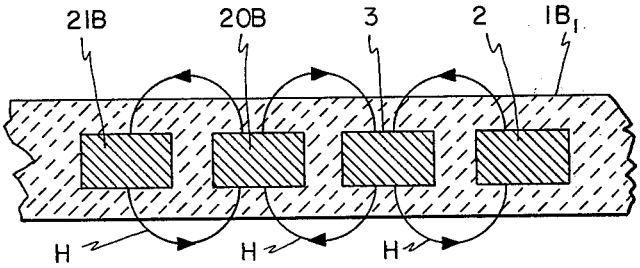
FIG. 10 is a partial side view, like FIG. 2, of a modification of the insulator of FIG. 1.

All the insulators herein disclosed have means for creating a magnetic field at least at one surface of at least one skirt or shed or shell thereof, said field having a component perpendicular to said at least one surface and creating a closed-loop path region wherein the magnetic field is present so that an arc in the course of flashover must pass through the magnetic field. The magnetic field in the embodiments of FIGS. 1–3 is created by an annular-shaped permanent magnet 2 embedded in the shell 4 and just below the surface 4A thereof; the annular magnet 2 is coaxial with the circularly symmetric shell 4. As shown in FIG. 2, the field labeled H has a component orthogonal to both the uppersurface 4A and the lower surface 4B. A further or second annular-shaped permanent magnet 3 creates a magnetic field H at said at least one surface 4A but oppositely directed to the field of the magnet 2. The annular magnet 3 is spaced radially outward from the annular magnet 2 a distance *a* (see FIG. 2), and the plane of each, as shown, is substantially orthogonal to the axis, designated A in FIG. 3, of the shell 4. There can be additional annular magnets 20B, 21B, etc., in the insulator shown at $1B_1$ in FIG. 10, each having a component perpendicular to the surface of the shell and of alternate polarity so that adjacently disposed magnets are oppositely polarized, as is shown in FIG. 10. The first or interior magnet can be disc as shown at $2A_1$ and $2A_2$ in FIG. 9 wherein the rod-type insulator is designated 108 and two outer annular rings are labeled $3A_1$ and $3B_1$. The purpose served by the annular magnetic field regions is discussed in the next paragraph.

Referring now to FIG. 2 and considering only the annular-shaped field region H created by the permanent magnet 2, as an arc passes over the surface 4A in a generally radial direction and through the field region, it is deflected sideways by the $\bar{I} \times \bar{B}$ forces in said region. In a cylindrical geometry, the arc will be rotated in a circle about the axis A; the rapid sideways motion (i.e., circumferential motion) of the arc interferes with the forward motion (i.e., radial motion) thereof and thereby hinders flashover. Photos taken of a test arrangement show that a discharge activity occurs at the surface 4A from the axis outward to the outer periphery of the annulus 2 and stops there. As above noted, the work done is in connection with d-c systems; it is contemplated that use in a-c systems may be less effective since the magnetic force on the arc may produce little or no motion. The use of the second annular magnet 3 that is closely spaced radially outward from the magnet 2 intensifies the magnetic and, hence, the $\bar{I} \times \bar{B}$ forces. (The annulus 3 can be soft magnet iron or some other magnetically permeable material, but the effect will be less.) The embodiment of FIG. 10 creates a shearing effect whereby the arc between the longitudinal axis and the first pair of oppositely polarized magnets 2 and 3 will rotate in an angular direction and in the radial space between the magnets 3 and 20B and near the magnet 20B will attempt to rotate in the opposite direction, creating a shearing of the arc. Further outwardly-spaced magnets 21B, etc., enhance the cut-off or shearing effect. The effect of the magnetic field just described may be further enhanced by use of discrete conductors 5A–5P in FIG. 1, which serve the same purpose as in the apparatus of said application Ser. No. 570,147, now U.S. Pat. 3,963,858; namely, the discrete conductors 5A–5P are arranged in a configuration and are sufficient in number to intercept an arc in the event of incipient flashover from proceeding radially past the same and thus prevent flashover. Typically, the circularly-symmmetric shell 4 has a radius of about five inches, the major radius of the annular magnet 2 is about two inches, the further magnets 3, etc., are spaced radially outwardly from adjacent magnets by a gap of about ¼ inch, the *d* dimension between the conductive spheriods 5A–5P in FIG. 1 is about 1½ inches. The insulator 1 has conductive spheroids 6E . . . at the lower surface 4B (actually the same number as at the surface 4A) inside an outer petticoat 7C or further petticoats 7A and 7B.

Figure 5:
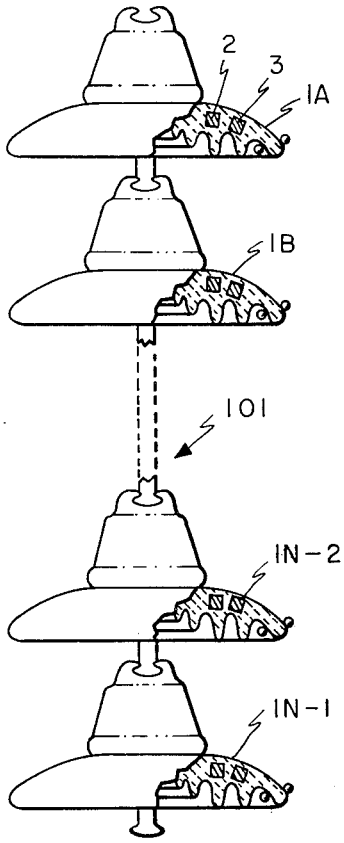
FIG. 5 is a side view, on an enlarged scale and partly cutaway, of an insulator string like that in FIG. 4.
Figure 6:
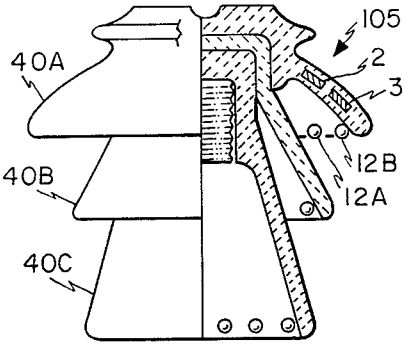
FIG. 6 is a side, cutaway view of a pin-type insulator embodying the present inventive concepts.

Turning now to FIG. 5, insulators 1A to 1N-1 have annular magnets embedded in each, the magnets in the insulator 1A being marked 2 and 3, as before. The pin-type insulator 105 in FIG. 6 is composed of the insulating shells 40A . . . , as above noted, which are secured together in a stacked configuration. Each shell has two permanent magnets embedded therein marked with the numbers 2 and 3, as before, and there are secured at the undersurface thereof conductive spheriods of which only the spheroids marked 12A and 12B at the undersurface of the shell 40A are labeled.

Figure 7:
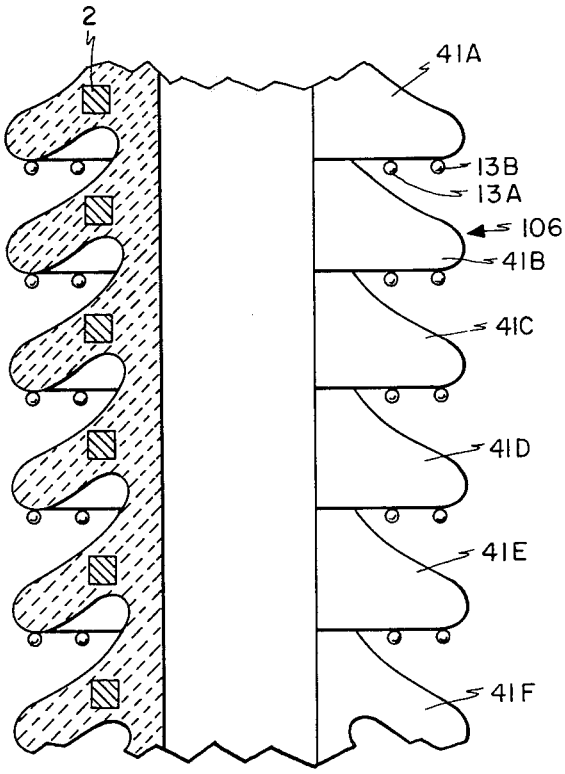
FIGS. 7 and 8 are side, partly cutaway, partial views respectively of a post-type insulator and a rod-type insulator embodying the present inventive concepts.
Figure 8:
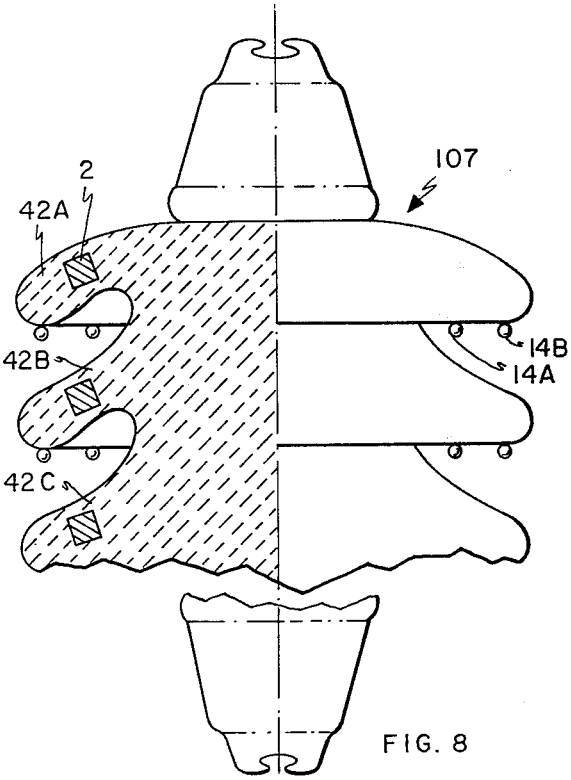

Whereas the string insulator 101 and the pin-type insulator 105 are formed by combining a number of individual units or shells, the post-type insulator 106 and the rod-type insulator 107 are unitary structures which may be formed of ceramic or glass or a synthetic material having a slightly differently shaped skirt or shed or shell than that shown in FIGS. 7 and 8. Again, there is embedded in each skirt or shed or shell an annular-shaped permanent magnet (again, one only of the magnets is marked 2) and conductive spheroids are located at the underside of the skirts or sheds or shells of the respective insulators, only spheroids 13A and 13B as to the insulator 106 and spheroids 14A and 14B as to the insulator 107 being marked in the figures. The magnets 2, etc., are preferably annular in shape but the disc structure in FIG. 9 can be used; also the magnets 2, etc., can be replaced by individual permanent magnets disposed along a circular path. The vital factor here is that there be a closed magnetic path, that is, one through which any incipient arc must pass to create flashover.

Figure 11:
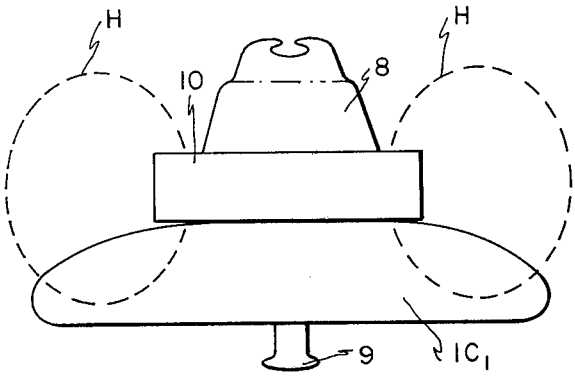
FIG. 11 is a side view of a further modification.

In the embodiment of FIG. 11 the shell is labeled $1C_1$ and a magnetic field, as before, is created by an annular permanent magnet 10 disposed around the conductive cap or fitting 8 (which may be aluminum) and mounted coaxially with the shell $1C_1$. The annular magnet 10 is positioned so that the magnetic field thereof provides a closed-path magnetic region at the upper surface of the shell $1C_1$, having a component orthogonal to the upper surface, as before. Hence, again, in the event of incipient flashover an arc must pass through the magnetic field.

Modifications of the invention herein disclosed will occur to persons skilled in the art and all such modifications are deemed to be within the spirit and scope of the invention as defined by the appended claims.

What is claimed is:

1. An insulator that comprises, in combination, a plurality of electrically insulating skirts or sheds or shells formed in such a way that an arc in the course of flashover with respect to each skirt or shed or shell must occur by moving generally radially across one surface of the skirt or shed or shell to the other surface thereof; and means for creating a magnetic field at at least one said surface having a component perpendicular to said at least one surface and creating a closed-path region wherein the magnetic field is present so that an arc in the course of incipient flashover must pass through the magnetic field.

2. An insulator as claimed in claim 1 that further includes means for creating a second magnetic field at said at least one surface having a component perpendicular to said at least one surface but oppositely directed to the first-named magnetic field, the second magnetic field being oppositely polarized to the first named magnetic field and being created over a closed-path region that is disposed radially outward from the first-named closed-path region.

3. An insulator as claimed in claim 2 in which said first named magnetic field and said second magnetic field are both produced by one or more annular-shaped magnets consisting of permanently magnetizable material, said magnets being permanently magnetized in opposite directions in such a manner that an arc in the course of flashover is transversely deflected in opposite directions by the two fields.

4. An insulator as in claim 3 in which said magnets are two or more annular rings or an inner disc and outer rings, said rings, said disc and outer ring or rings being in close proximity to one another and disposed concentrically in such a manner that oppositely polarized pole faces lie adjacent to each other and just beneath the insulator surface.

5. An insulator as claimed in claim 2 in which the skirts or sheds or shells are circular in cross dimensions, in which the means for creating the first-named magnetic field comprises annular-shaped first permanent magnet means embedded in at least one skirt or shed or shell, and in which the means for creating the second field comprises second annular-shaped permanent magnet means disposed radially outward from the permanent magnet means in said at least one skirt or shed or shell.

6. An insulator as in claim 1 that includes means for creating a plurality of additional magnetic fields at said at least one surface, each field having a component perpendicular to said at least one surface and of alternating polarity commencing in a radially outward direction from said first-named magnetic field.

7. An insulator as claimed in claim 1 that includes a plurality of discrete, smooth-surfaced conductors disposed to lie along a closed path, said discrete conductors being spaced from one another sufficiently close that an incipient arc is, in the course of formation, intercepted by one or the other of said conductors, the path along which the conductors are disposed being located radially outward from said closed-path region.

8. An insulator as in claim 1 in which said means for creating a magnetic field is one or more magnets consisting of permanently magnetizable material, said magnets being permanently magnetized and disposed within or about the insulator in such a manner that an arc in the course of flashover must pass through the magnetic field thereby produced.

9. An insulator as in claim 8 in which said magnets are in the form of either discs or rings, said discs or said rings being coaxial with the body of the insulator.

10. An insulator as in claim 9 in which said magnets are embedded within the body of the insulator, and are disposed such that their pole faces lie just under a portion of the insulator surface over which an arc must pass in the course of flashover.

11. An insulator as claimed in claim 1 in which the skirts or sheds or shells are circular in cross dimensions, in which the means for creating the magnetic field comprises permanent magnet means embedded in at least one skirt or shed or shell and magnetically permeable means also embedded in the same skirt or shed or shell disposed in such a manner as to increase the intensity of the magnetic field and provide a field configuration that is more effective than obtainable without said magnetically permeable means.

12. An insulator as claimed in claim 1 in which the means for creating said magnetic field comprises an annular permanent magnet mounted coaxially with the skirt or shed or shell and positioned so that the magnetic field of the magnet provides the perpendicular component of the field at said one surface.

13. An insulator that comprises, in combination, an electrically insulating skirt or shed or shell formed in such a way that an arc in the course of flashover with respect to the skirt or shred or shell must occur by moving generally radially across one surface of the skirt or shed or shell to the other surface thereof; and means for creating a closed-path magnetic field at at least one said surface, having a component perpendicular to said at least one surface and creating a region wherein the magnetic field is present such that an arc in the course of incipient flashover must pass through the magnetic field.

14. An insulator as claimed in claim 13 that further includes means for creating a second magnetic field at said at least one surface having a component perpendicular to said at least one surface but oppositely directed or polarized to the first-named magnetic field, the second field being created over a closed-path region that is disposed radially outward from the first-named region.

15. An insulator as claimed in claim 13 that includes a plurality of discrete, smooth-surfaced conductors disposed to lie along a closed-path, said discrete conductors being spaced from one another sufficiently close that an incipient arc is, in the course of formation, intercepted by one or the other of said conductors, the path along which the conductors are disposed being located radially outward from the region of the magnetic field.

16. An insulator that comprises, in combination, two end fittings, a dielectric body between the two end fittings and attached firmly thereto, and means for creating a magnetic field having a component orthogonal to an exposed surface of the dielectric body at a region thereof, said region forming a closed-loop path so that any arc in the course of flashover between said fittings must pass through said magnetic field.

* * * * *